US009521899B1

(12) United States Patent
Tai

(10) Patent No.: US 9,521,899 B1
(45) Date of Patent: Dec. 20, 2016

(54) SWING-TRIGGERED FLASHING TOOTHBRUSH

(71) Applicant: SHUMMI ENTERPRISE CO., LTD., Taipei (TW)

(72) Inventor: Pu Tai, Taipei (TW)

(73) Assignee: SHUMMI ENTERPRISE CO., LTD., Taipei (TW)

( * ) Notice: Subject to any disclaimer, the term of this patent is extended or adjusted under 35 U.S.C. 154(b) by 0 days.

(21) Appl. No.: 14/802,567

(22) Filed: Jul. 17, 2015

(51) Int. Cl.
*A46B 15/00* (2006.01)
*A46B 5/02* (2006.01)

(52) U.S. Cl.
CPC ..... *A46B 15/0036* (2013.01); *A46B 5/02* (2013.01); *A46B 15/0004* (2013.01); *A46B 15/0042* (2013.01); *A46B 15/0044* (2013.01); *A46B 15/0087* (2013.01); *A46B 15/0097* (2013.01)

(58) Field of Classification Search
CPC . A46B 15/0036; A46B 15/02; A46B 15/0087; A46B 15/0042; A46B 15/0044; A46B 15/0004
USPC ..... 15/22.1, 105, 167.1
See application file for complete search history.

(56) References Cited

U.S. PATENT DOCUMENTS 4,253,212 A * 3/1981 Fujita ..... A46B 15/0002 15/167.1
4,588,387 A * 5/1986 Swenson ..... A63H 5/00 362/205
4,744,124 A * 5/1988 Wang ..... A46B 15/0002 15/105
4,779,173 A * 10/1988 Carr ..... A46B 15/0002 15/105
4,979,708 A * 12/1990 Aoki ..... A47K 1/09 248/110
5,673,451 A * 10/1997 Moore ..... A46B 15/0036 15/105
5,813,855 A * 9/1998 Crisio, Jr. ..... A46B 15/0002 15/167.1
6,036,576 A * 3/2000 Colon, Jr. ..... A63H 33/009 446/170
6,106,294 A * 8/2000 Daniel ..... A46B 15/0002 15/105
6,389,633 B1 * 5/2002 Rosen ..... A46B 15/0002 15/105
6,850,167 B2 * 2/2005 Rosen ..... A46B 15/0002 15/1

(Continued)

*Primary Examiner* — Michael Jennings
(74) *Attorney, Agent, or Firm* — Muncy, Geissler, Olds & Lowe, P.C.

(57) ABSTRACT

A swing-triggered flashing toothbrush comprises a hollow brush handle having a movement space; a transparent patterned layer formed on the surface of the hollow brush handle and having a press button and an operable grip coupled to the press button; a control circuit board arranged inside the hollow brush handle, and a metallic ball arranged inside the operable grip. The press button controls the operable grip to hold the metallic ball or release the metallic ball to the movement space. Once the metallic ball is released, a swing movement drives the metallic ball to hit the interior of an electric-connection chute of the control circuit board. Thus, the control circuit board is triggered to control a battery assembly to power light emitting elements. Thereby, the light emitting elements project light outwards through the transparent patterned layer.

15 Claims, 7 Drawing Sheets

(56) References Cited

U.S. PATENT DOCUMENTS

| | | | | |
|---|---|---|---|---|
| 8,006,342 | B2 * | 8/2011 | Nanda | A46B 15/0002 15/105 |
| 8,272,091 | B2 * | 9/2012 | Hwang | A46B 15/0006 15/22.1 |
| 8,424,144 | B2 * | 4/2013 | Nanda | A46B 15/0002 15/105 |
| 9,044,083 | B2 * | 6/2015 | Nanda | A46B 9/04 |
| 9,387,059 | B2 * | 7/2016 | Utsch | A61C 17/3436 |
| 2007/0261185 | A1 * | 11/2007 | Guney | A46B 15/0002 15/22.1 |
| 2008/0276393 | A1 * | 11/2008 | Russell | A46B 7/00 15/105 |
| 2014/0259469 | A1 * | 9/2014 | Garrigues | A61C 17/3481 15/22.1 |

* cited by examiner

SWING-TRIGGERED FLASHING TOOTHBRUSH

FIELD OF THE INVENTION

The present invention relates to a swing-triggered flashing toothbrush, particularly to a toothbrush triggered to flash by a metallic ball that is driven to roll by a swing movement.

DESCRIPTION OF THE RELATED ART

The toothbrush is an indispensible instrument for oral health. Toothbrushes are used by people daily to clean their teeth and massage the gums. Therefore, the toothbrush can enhance blood circulation and disease resistance of the mouth and prevent from tooth decay and periodontal disease.

At present, there are various types of toothbrushes available in the market, such as electric toothbrushes, collapsible toothbrushes, health care toothbrushes, disposable toothbrushes, and flashing toothbrushes. They respectively have different advantages and apply to different situations. For example, the flashing toothbrush emits light to facilitate users to view the cleanness of the oral cavity and provides an amusing effect to lure children to clean the teeth everyday. The flashing toothbrushes available in the market normally have a built-in electronic circuit board able to emit light, wherein a switch is used to turn on the light source to project light outwards through the brush head or the light-permeable brush handle. However, the conventional flashing toothbrushes have a disadvantage: their batteries are unlikely to replace. Some manufacturers developed flashing toothbrushes whose batteries can be replaced, wherein a circuit board having a light emitting function is arranged inside the brush handle, and batteries are placed inside the brush handle and electrically connected with the circuit board; a cap is locked to the rear end of the brush handle to prevent the batteries and the circuit board from dropping out of the brush handle. Normally, corresponding threads are formed at the cap and the rear end of the brush handle and screwed together to lock the cap and the brush handle. Although the abovementioned flashing toothbrushes allow users to replace batteries, they lack a fixing structure to fix the batteries and circuit board to the interior of the brush handle. Thus, the movement of brushing teeth causes the batteries and circuit board to shake inside the brush handle and collide with the inner wall of the brush handle. Thus, the circuit board is likely to break down, and the batteries may have loose contact. Besides, the press buttons of the conventional flashing toothbrushes may malfunction after long-term usage because of abrasion or inappropriate operation. As the press button is unlikely to replace, the entire flashing toothbrush would be abandoned. Therefore, the conventional flashing toothbrushes still have room to improve in practicability and stability.

Accordingly, the present invention proposes a swing-triggered flashing toothbrush to overcome the abovementioned problems.

SUMMARY OF THE INVENTION

The primary objective of the present invention is to provide a swing-triggered flashing toothbrush, which is precisely triggered to flash by a simple swing-triggering mechanism, and which has an amusing effect encouraging children to keep their oral health persistently.

Another objective of the present invention is to provide a swing-triggered flashing toothbrush, which is triggered to emit music by a simple swing-triggering mechanism to lure children to brush their teeth and favor their oral health.

To achieve the abovementioned objective, the present invention proposes a swing-triggered flashing toothbrush, which comprises a brush head, a hollow brush handle, a cap, a metallic ball and a control circuit board. The front end of the hollow brush handle is connected with the brush head. The hollow brush handle has a transparent patterned layer. The rear end of the hollow brush handle has an opening, and the cap is arranged at the opening. A movement space is formed between the cap and the hollow brush handle for the rolling of the metallic ball. The cap has a press button and an operable grip connected with the press button. While not using the lighting function, the user operates the press button to control the operable grip to hold the metallic ball. While intending to let the flashing tooth brush emit light, the user operates the press button once again to release the metallic ball to the movement space. The control circuit board is arranged inside the hollow brush handle and includes a control circuit, at least one light emitting element electrically connected with the control circuit, a battery assembly, and an electric-connection chute. The opening of the electric-connection chute grows from small to large gradually. The operable grip is arranged corresponding to the largest region of the opening. A swing movement will drive the metallic ball to move inside the movement space and hit the interior of the electric-connection chute. Then, the control circuit is triggered to control the battery assembly to power the light emitting element. Thereby, the light emitting element projects light outwards through the transparent patterned layer. Thus, the transparent figures of the transparent patterned layer emit light or flash.

The present invention also proposes a swing-triggered flashing toothbrush, which comprises a hollow brush handle, a metallic ball and a control circuit board. The hollow brush handle has a movement space at the interior thereof, a transparent patterned layer on the surface thereof and a side opening on the lateral surface thereof; the hollow brush handle also has a press button and an operable grip coupled to the press button. The side opening has an assembly member; a cover matches the side opening and has a press-fit member. The engagement of the press-fit member and the assembly member secures the cover to the hollow brush handle. The metallic ball is arranged in the operable grip. The press button controls the operable grip to hold the metallic ball or release metallic ball to the movement space. The control circuit board is arranged inside the hollow brush handle and includes a control circuit, at least one light-emitting element electrically connected with the control circuit, a battery assembly, and an electric-connection chute. The electric-connection chute has an opening growing from small to large. The operable grip is arranged corresponding to the largest region of the opening. The metallic ball is hit into the electric-connection chute to trigger the control circuit to control the battery assembly to power the light-emitting element. Thus, the light-emitting element projects light outwards through the transparent patterned layer.

Below, embodiments are described in detail to make easily understood the objectives, technical contents, characteristics and accomplishments of the present invention.

DETAILED DESCRIPTION OF THE INVENTION

Figure 1:
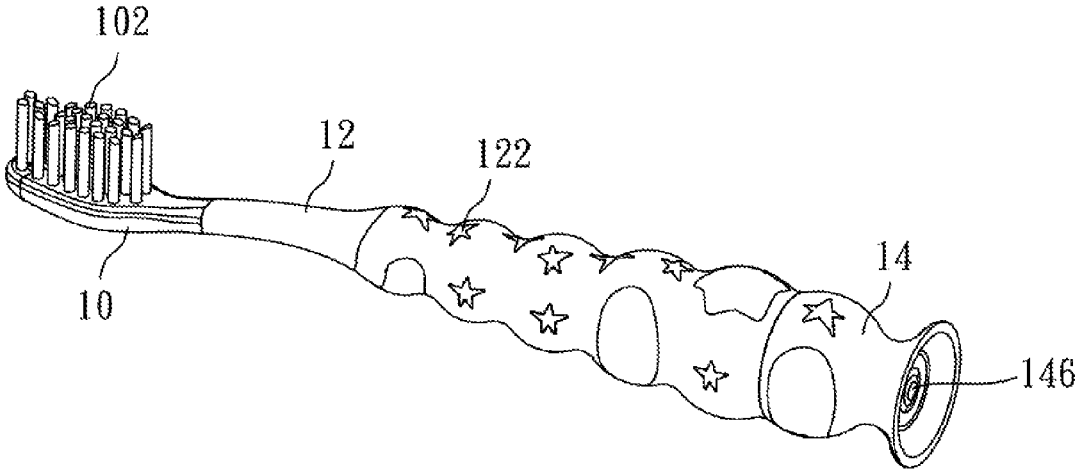
FIG. 1 is a perspective view schematically showing a swing-triggered flashing toothbrush according to one embodiment of the present invention.
Figure 2:
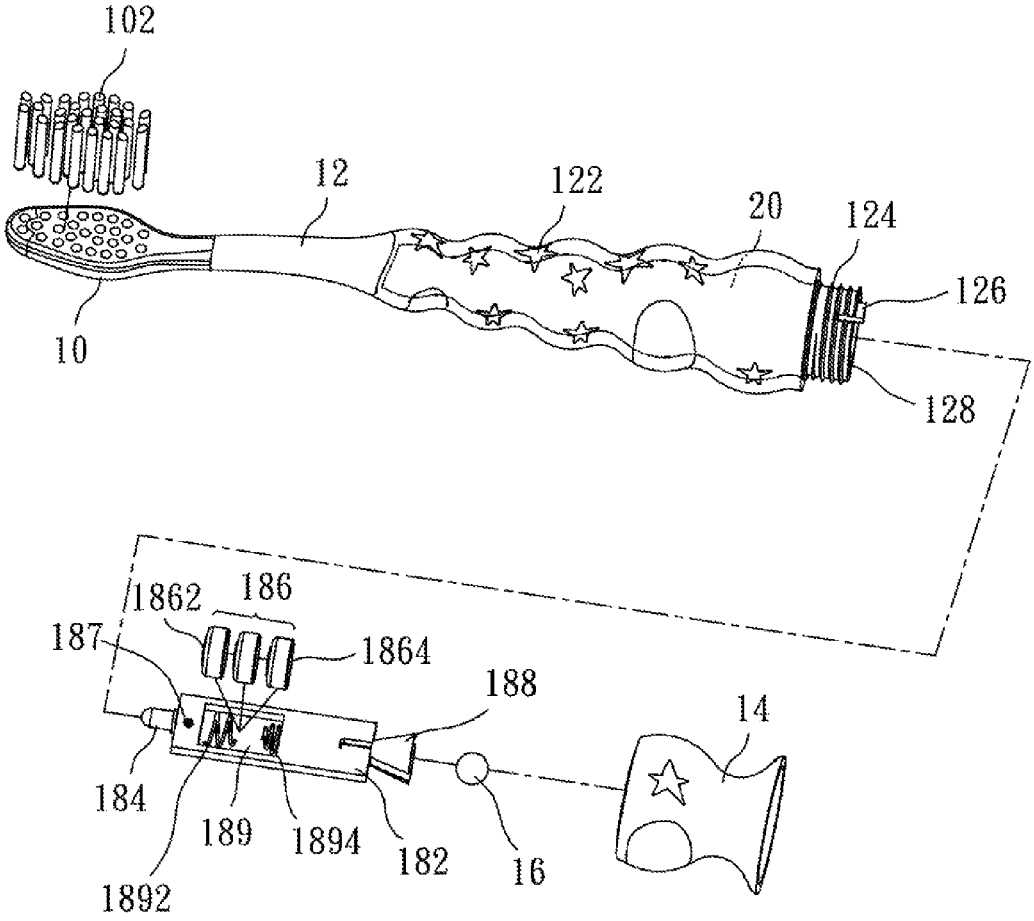
FIG. 2 is an exploded view schematically showing a swing-triggered flashing toothbrush according to one embodiment of the present invention.

The present invention proposes a swing-triggered flashing toothbrush meeting ergonomics and featuring utility, amusement and durability. Refer to FIG. 1 and FIG. 2 respectively a perspective view and an exploded view schematically showing a swing-triggered flashing toothbrush according to one embodiment of the present invention. The swing-triggered flashing toothbrush of the present invention comprises a brush head 10, a hollow brush handle 12, a cap 14, a metallic ball 16 and a control circuit board 18. The front end of the hollow brush handle 12 is connected with the brush head 10. The brush head 10 has a plurality of bristles 102, and the material and style of the bristles 102 are designed to enhance oral health. The hollow brush handle 12 has a transparent patterned layer 122, which may have various figures, such as the figures of stars, circles, animals, etc. The figures of the transparent patterned layer 122 are customized to meet the personal bias of a user, or designed to meet the demand of the market. In one embodiment, the swing-triggered flashing toothbrush further comprises a brush handle protection shell (not shown in the drawings) sleeving the hollow brush handle 12. The brush handle protection shell has a plurality of patterned holes. A plurality of transparent patterned bumps of the transparent patterned layer 122 is expose to the patterned holes, and the hollow brush handle 10 set on brush handle protection shell 16, that was made by injection-molding. Therefore, the brush handle protection shell can improve the esthetics and toughness of the swing-triggered flashing toothbrush.

Figure 3:
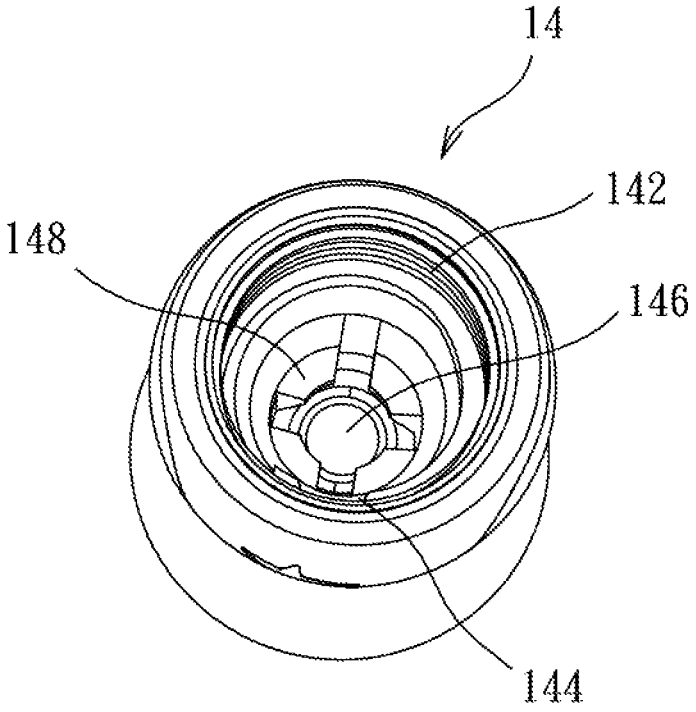
FIG. 3 is a diagram schematically showing the structure of the cap according to one embodiment of the present invention.

Refer to FIG. 3 a diagram schematically showing the structure of the cap according to one embodiment of the present invention. The rear end of the hollow brush handle 12 has an opening revealing a movement space 20. The cap 14 includes an inner thread 142 and a positioning recess 144. The opening of the hollow brush handle 12 includes an outer thread 124. The outer thread 124 has a positioning block 126. The cap 14 is engaged with the hollow brush handle 12 via screwing the outer thread 124 of the hollow brush handle 12 into the inner thread 142 of the cap 14 until the positioning block 126 is press-fit to the positioning recess 144. Thereby, the cap 14 is securely locked to the hollow brush handle 12, and the movement space 20 is formed between the cap 14 and the hollow brush handle 12 for the movement of the metallic ball 16. The metallic ball 16 is held or released to the movement space 20 by a press button 146 and an operable grip 148 of the hollow brush handle 12. In one embodiment, the press button 146 and the operable grip 148 are arranged at the rear end of the cap 14, wherein the operable grip 148 is disposed at the inner bottom of the cap 14. Pressing the press button 146 will actuate the operable grip 148 to hold the metallic ball 16 or release the metallic ball 16 to the movement space 20.

The inner wall of the hollow brush handle 12 has at least one slide rail 128. The control circuit board 18 is slid into the slide rail 128 and secured thereto. The design exempts the control circuit board 18 from being detached by vibration or collision and enhances the security of the control circuit board 18. The control circuit board 18 includes a control circuit 182, at least one light-emitting element 184, an audio element 187, a battery assembly 186, and an electric-connection chute 188, wherein the light-emitting element 184 and the audio element 187 are electrically connected with the control circuit 182. The control circuit board 18 further includes a battery accommodation bay 189 having a positive contact 1892 and a negative contact 1894 respectively at two ends thereof. The positive contact 1892 and the negative contact 1894 are electrically connected with the control circuit 182. The battery accommodation bay 189 is arranged between the light-emitting element 184 and the electric-connection chute 188. The battery assembly 186 is installed inside the battery accommodation bay 189. The positive electrode 1862 of the battery assembly 186 is pressed against the positive contact 189, and the negative electrode 1864 of the battery assembly 186 is pressed against the negative contact 1894, whereby to form a loop. It should be noted: the electric-connection chute 188 extends outwards from one end of the control circuit 182; the opening of the electric-connection chute 188 gets larger and larger gradually, and the minimum width of the opening allows the metallic ball 16 to completely contact the inner rim of the electric-connection chute 188. The operable grip 148 is arranged corresponding to the maximum width of the electric-connection chute 188. The electric-connection chute 188 consists of two electric-conduction plates respectively connected with the positive terminal and the negative terminal of the control circuit 182. While the metallic ball 16 hits the smallest region of the opening of the electric-connection chute 188, the metallic ball 16 simultaneously contacts the inner rims of the two electric-conduction plates. Thus, the metallic ball 16 simultaneously contacts the positive terminal and the negative terminal of the control circuit 182, and a loop is formed. The electric-connection chute 188 may be designed to have a trumpet shape, a cone shape, or a pillar shape. Any electric-connection chute 188 with an opening enlarging gradually would be included within the scope of the present invention. While the metallic ball 16 is hit into the electric-connection chute 188, the control circuit 182 will trigger the battery assembly 186 to power the light-emitting element 184 and the audio element 187. Then, the light-emitting element 184 is activated to operate and project light outwards through the transparent patterned layer 122, and the audio element 187 is activated to emit music.

The user can take out the control circuit board 18 from the hollow brush handle 12 to replace the battery assembly 186 via merely rotating the cap 14 to detach the inner thread 142 of the cap 14 from the outer thread 124 of the hollow brush handle 12.

Figure 4A:
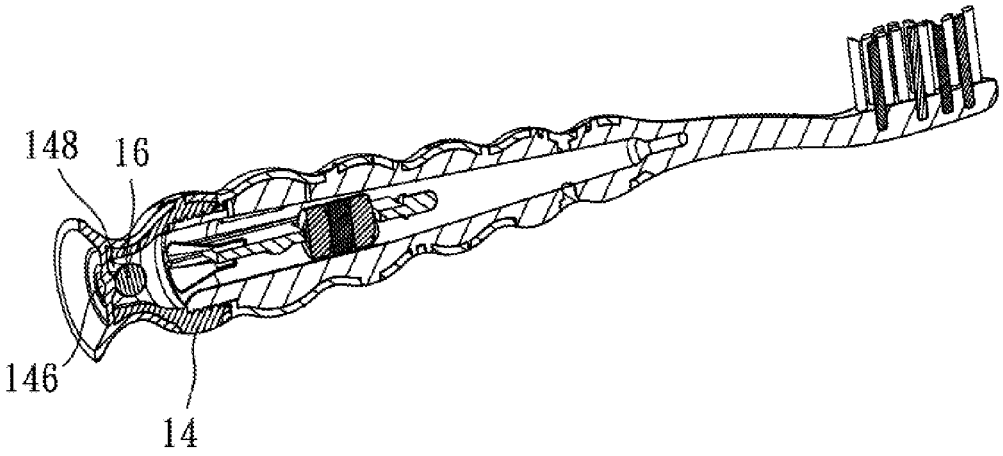
FIG. 4A and FIG. 4B are sectional views schematically showing the operation of a swing-triggered flashing toothbrush according to one embodiment of the present invention.
Figure 4B:
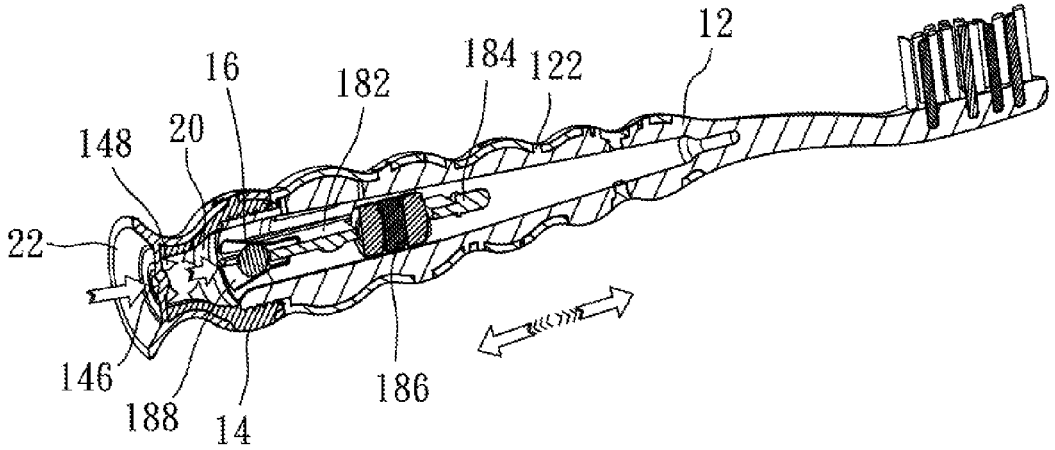

Refer to FIG. 4A and FIG. 4B sectional views schematically showing the operation of a swing-triggered flashing toothbrush according to one embodiment of the present invention. The inner rim of the operable grip 148 has at least two plastic protrusions. In the embodiment shown in FIG. 4A, the inner rim of the operable grip 148 has four plastic protrusions. While the lighting function of the swing-triggered flashing toothbrush does not operate, the press button 146 controls the four plastic protrusions of the operable grip 148 to grip the metallic ball 16 firmly. Thus, the metallic ball 16 is kept inside the cap 14. If the user intends to let the toothbrush of the present invention light up, he presses the press button 146 to release the metallic ball 16 to roll from the cap 14 to the movement space 20, as shown in FIG. 4B. While the user swings the swing-triggered flashing toothbrush with his hand, the metallic ball 16 will roll to the electric-connection chute 188 and then roll from the biggest region of its opening to the bottom of the smallest region of the opening. The moment the metallic ball 16 hits the smallest region of the opening of the electric-connection chute 188, the metallic ball 16 simultaneously contacts the inner rims of the two electric-conduction plates, i.e. the positive terminal and the negative terminal of the control circuit 182, to form a loop and generate a triggering signal. According to the triggering signal, the control circuit 182 controls the battery assembly 186 to power the light-emitting element 184 and the audio element 187. In the present invention, the light-emitting element 184 is preferably an LED (Light Emitting Diode) light. Then, the light-emitting element 184 projects light outwards through the transparent patterned layer 122. Thereby, the patterns light up or flash. Further, the audio element 187 provides music to amuse the user. While the user cleans his teeth with the toothbrush, he will persistently swing the toothbrush. Therefore, the metallic ball 16 keeps rolling inside the movement space 20, hitting the electric-connection chute 188 and triggering the light-emitting element 184. In the present invention, the light-emitting element 184 may emit light in various modes. For example, the light-emitting element 184 emits light continuously for N seconds, or emits light intermittently (flashes). The lighting modes of the light-emitting element 184 can be programmed in the control circuit 182 according to the requirements of users. The present invention does not particularly limit the light modes of the light-emitting element 184. While the user has finished cleaning his teeth, he turns the swing-triggered flashing toothbrush to be vertical to the ground to let the metallic ball 16 roll to the cap 14. Next, the user presses the press button 146 once again to let the four plastic protrusions of the operable grip 148 open and have an appropriate width allowing the metallic ball 16 to drop into the operable grip 148. Next, the user releases the press button 146 to let the four protrusions grip the metallic ball 16 firmly, whereby the metallic ball 16 would not roll back to the movement space 20. In one embodiment, the cap 14 further includes a suction disc 22, whereby the swing-triggered flashing toothbrush of the present invention is stuck onto a plane vertically by the suction disc 22, neither using a toothbrush stand nor dropping to the ground. Therefore, the present invention is very economically efficient.

Figure 5A:
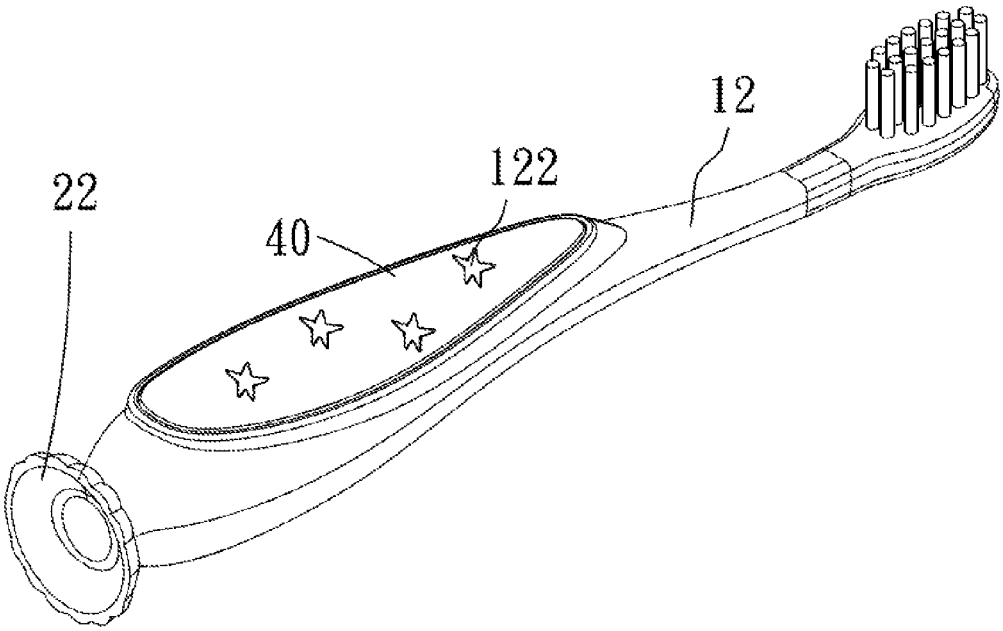
FIG. 5A is a perspective view schematically showing a swing-triggered flashing toothbrush according to another embodiment of the present invention.
Figure 5B:
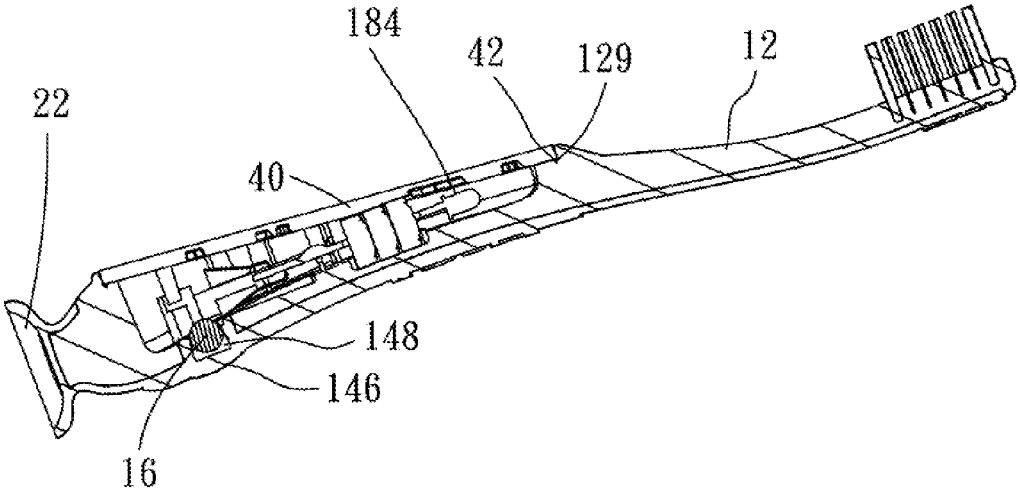
FIG. 5B is a sectional view schematically showing a swing-triggered flashing toothbrush according to another embodiment of the present invention.

Refer to FIG. 5A and FIG. 5B for another embodiment of the present invention. In addition to the opening formed at the rear end of the hollow brush handle 12, the swing-triggered flashing toothbrush of the present invention further comprises a side opening on the lateral surface of the hollow brush handle 12, as shown in FIG. 5A and FIG. 5B. In the embodiment shown in FIG. 5A and FIG. 5B, a cover 40 covers the side opening and has the transparent patterned layer 122, through which the light-emitting element 184 projects light outwards. The cover 40 has a press-fit member 42, and the side opening of the hollow brush handle 12 has an assembly member 129. Through the engagement of the press-fit member 42 and the assembly member 129, the cover 40 is secured to the hollow brush handle 12. In the embodiment shown in FIG. 5A and FIG. 5B, the press button 146, the operable grip 148 coupled to the press button 146, and the suction disc 22 are not necessarily formed on the cover 40 but may be formed on the hollow brush handle 12 and disposed at the rear end of the hollow brush handle 12. Alternatively, the cover 40 may be joined with the hollow brush handle 12 by ultrasonic welding. The structure of the embodiment is basically similar to that of the abovementioned embodiment except the formation of the cover 40 and the position of the press button 146 and the operable grip 148. Therefore, it will not repeat herein.

In conclusion, the present invention uses swings to trigger a flashing toothbrush to emit light and music, easy to operate, amusing users, and likely to attract the attention of users. Further, the triggering mechanism using a metallic ball can solve the conventional problem that the press-button type toothbrush is likely to break down by inappropriate operation. The present invention can enhance the utility of toothbrushes and prolong the service life of toothbrushes and thus has high potential in the market.

The embodiments described above are only to exemplify the present invention but not to limit the scope of the present invention. Any equivalent modification or variation according to the characteristic or spirit of the present invention is to be also included within the scope of the present invention.

What is claimed is:

1. A swing-triggered flashing toothbrush comprising a brush head;

a hollow brush handle, whose front end is connected with said brush head, whose surface has a transparent patterned layer, whose interior has a movement space, and which has a press button and an operable grip coupled to said press button;

a metallic ball, arranged inside said operable grip, wherein said press button is used to control said operable grip to grip said metallic ball or release said metallic ball to said movement space; and a control circuit board, arranged inside said hollow brush handle, and including a control circuit, at least one light-emitting element electrically connected with said control circuit, a battery assembly, and an electric-connection chute, wherein said electric-connection chute has an opening growing from small to large; said operable grip is arranged corresponding to a largest region of said opening; said metallic ball is hit into said electric-connection chute to trigger said control circuit to control said battery assembly to power said light-emitting element; said light-emitting element projects light outwards through said transparent patterned layer;

wherein at least two plastic protrusions are arranged along an inner rim of said operable grip and used to grip or release said metallic ball.

2. The swing-triggered flashing toothbrush according to claim 1, wherein said hollow brush handle has at least one slide rail on an inner wall thereof; said control circuit board is slid into said slide rail.

3. The swing-triggered flashing toothbrush according to claim 1, wherein said electric-connection chute has a trumpet shape, a cone shape or a pillar shape.

4. The swing-triggered flashing toothbrush according to claim 1, wherein said electric-connection chute has two electric-conduction plates respectively connected with a positive terminal and a negative terminal of said control circuit.

5. The swing-triggered flashing toothbrush according to claim 1, wherein a rear end of said hollow brush handle has an opening revealing said movement space.

6. The swing-triggered flashing toothbrush according to claim 5, wherein said hollow brush handle has a cap covering said movement space, and wherein said press button and said operable grip are arranged in said cap.

7. The swing-triggered flashing toothbrush according to claim 6, wherein said cap has an inner thread and a positioning recess; said opening of said hollow brush handle has an outer thread and a positioning block formed on said outer thread; said outer thread is screwed to engage with said inner thread until said positioning block is press-fit to said positioning recess, whereby said cap is secured to said hollow brush handle.

8. The swing-triggered flashing toothbrush according to claim 1, wherein said hollow brush handle has a side opening revealing said movement space.

9. The swing-triggered flashing toothbrush according to claim 8 further comprising a cover having a press-fit member, wherein said side opening of said hollow brush handle has an assembly member, and wherein said press-fit member is engaged with said assembly member to secure said cover to said hollow brush handle.

10. The swing-triggered flashing toothbrush according to claim 9, wherein said cover is joined with said hollow brush handle by ultrasonic welding.

11. The swing-triggered flashing toothbrush according to claim 1, wherein said control circuit board further comprises a battery bay whose two ends respectively have a positive contact and a negative contact; said positive contact and said negative contact are respectively electrically connected with a positive electrode and a negative electrode of said battery assembly.

12. The swing-triggered flashing toothbrush according to claim 1, wherein said light-emitting element is an LED (Light-Emitting Diode) light.

13. The swing-triggered flashing toothbrush according to claim 1 further comprising a brush handle protection shell, which sleeves said hollow brush handle and has a plurality of patterned holes, wherein a plurality of transparent patterned bumps of said transparent patterned layer is expose to said patterned holes.

14. The swing-triggered flashing toothbrush according to claim 1, wherein a rear end of said hollow brush handle has a suction disc; said swing-triggered flashing toothbrush is stuck onto a plane by said suction disc.

15. The swing-triggered flashing toothbrush according to claim 1, wherein said control circuit board further comprises an audio element electrically connected with said control circuit, and wherein said metallic ball hits interior of said electric-connection chute to trigger said control circuit to control said battery assembly to power said audio element to emit music.

* * * * *